US005889499A

United States Patent [19]

Nally et al.

[11] Patent Number: 5,889,499

[45] Date of Patent: Mar. 30, 1999

[54] SYSTEM AND METHOD FOR THE MIXING OF GRAPHICS AND VIDEO SIGNALS

[75] Inventors: Robert Marshall Nally; Christopher Lloyd Reinert, both of Plano, Tex.

[73] Assignee: S3 Incorporated, Santa Clara, Calif.

[21] Appl. No.: 683,102

[22] Filed: Jul. 16, 1996

Related U.S. Application Data

[63] Continuation of Ser. No. 98,846, Jul. 29, 1993.

[51] Int. Cl.[6] ..... G09G 5/00

[52] U.S. Cl. ..... 345/7; 345/113; 345/435

[58] Field of Search ..... 345/7, 8, 9, 112, 345/113, 114, 153, 154, 155, 156, 186, 187, 188, 435; 248/584, 585, 586, 587, 589, 590, 591, 592, 593

[56] References Cited

U.S. PATENT DOCUMENTS

| | | | |
|---|---|---|---|
| 4,437,092 | 3/1984 | Dean et al. | 340/703 |
| 4,484,187 | 11/1984 | Brown et al. | 340/703 |
| 4,554,538 | 11/1985 | Bieneman | 340/703 |
| 4,682,297 | 7/1987 | Iwami | 345/113 |
| 4,827,253 | 5/1989 | Maltz | 345/113 |
| 4,847,621 | 7/1989 | Colles . | |
| 4,857,929 | 8/1989 | Katzenstein . | |
| 4,899,151 | 2/1990 | Colles . | |
| 4,904,922 | 2/1990 | Colles . | |
| 4,982,343 | 1/1991 | Hourvitz et al. | 345/113 |
| 5,041,992 | 8/1991 | Cunningham et al. | 345/113 |
| 5,089,811 | 2/1992 | Leach | 345/113 |
| 5,138,307 | 8/1992 | Tatsumi | 340/721 |
| 5,220,312 | 6/1993 | Lumelsky | 348/589 |
| 5,351,067 | 9/1994 | Lumelsky et al. | 345/113 |

OTHER PUBLICATIONS

"Session XIV: Data Acquisition and Conversion, THPM 14.6: A 60 ns Glitch–Free NMOS DAC," V. Shen, D. Hodges, 1983 IEEE International Solid–State Circuits Conference, pp. 188–189.

"An 80–MHz 8–bit CMOS D/A Converter," T. Miki, Y. Nakamura, M. Nakaya, S. Asai, Y. Akasaka Y. Horiba, IEEE Journal of Solid–State Circuits, vol. SC–21, No. 6, Dec. 1986, pp. 983–988.

CL–PX2070 Preliminary Data Sheet, Digital Video Processor, Oct. 1992.

CL–PX2080 Preliminary Data Sheet, MedialDAC, Dec. 1992.

*Primary Examiner*—Mark K. Zimmerman
*Assistant Examiner*—Ronald Laneau
*Attorney, Agent, or Firm*—Fenwick & West LLP

[57] ABSTRACT

Disclosed is a system and method for mixing a plurality of graphics and video signals to create a desired output format, the desired output format being a mixture of the received signals. The mechanisim for achieving this rich format is a multi-modal graphics video overlay controller. The controller having a set of opcodes, selects a subset of the opcode set, this selection being a function of a desired output format of the mixed signals. The subset of opcodes is then utilized to control the means for selectively switching among the received graphics and video signals to create the desired output format. The selective switching is accomplished on a pixel by pixel basis.

54 Claims, 3 Drawing Sheets

| T | O | W | GOO 1 | 2 | 3 | 4 | |
|---|---|---|---|---|---|---|---|
| 0 | 0 | 0 | 0 | 0 | 0 | 0 | A |
| 0 | 0 | 1 | 0 | 0 | 0 | 0 | B |
| 0 | 1 | 0 | 0 | 1 | 0 | 0 | C |
| 0 | 1 | 1 | 1 | 1 | 0 | 0 | D |
| 1 | 0 | 0 | 0 | 0 | 1 | 0 | E |
| 1 | 0 | 1 | 0 | 0 | 1 | 1 | F |
| 1 | 1 | 0 | 0 | 1 | 1 | 0 | G |
| 1 | 1 | 1 | 1 | 1 | 1 | 1 | H |

TAG IN X-Y WINDOW
TAG ONLY
GRAPHICS OVERLAY ONLY
GRAPHICS OVERLAY IN X-Y WINDOW

SYSTEM AND METHOD FOR THE MIXING OF GRAPHICS AND VIDEO SIGNALS

This application is a continuation, of application Ser. No. 08/098,846, filed Jul. 29, 1993.

TECHNICAL FIELD OF THE INVENTION

The present invention relates generally to the field of graphics and video processing, and, more specifically, to mixing of graphics and video signals.

CROSS-REFERENCE TO RELATED APPLICATIONS

The following copending and coassigned United States patent applications contain related material and are incorporated herein by reference:

U.S. patent application Ser. No. 08/099,083, Attorney Docket No. P3510-P07US, entitled "System And Method For Processing Multiple Received Signal Sources," filed concurrently herewith;

U.S. patent application Ser. No. 08/099,716, Attorney Docket No. P3510-P08US, entitled "System And Method For Displaying Multiple Data Screens To A Single Display Device," filed concurrently herewith;

U.S. patent application Ser. No. 08/098,844, Attorney Docket No. P3510-P09US, entitled "Apparatus, Systems, And Methods For Displaying A Cursor On A Display Screen," filed concurrently herewith;

U.S. patent application Ser. No. 08/099,723, Attorney Docket No. P3510-P10US, entitled "Method And System For Attaching Dynamic Control Codes To Received Real-Time Data Streams," filed concurrently herewith;

U.S. patent application Ser. No. 08/099,194, Attorney Docket No. P3510-P12US, entitled "Video Processing Apparatus, Systems And Methods," filed concurrently herewith;

U.S. patent application Ser. No. 08/099,835, Attorney Docket No. P3510-P13US, entitled "Method And System For Achieving Full Monotonic Signal Conversion," filed concurrently herewith;

U.S. patent application Ser. No. 08/099,158, Attorney Docket No. P3510-P14US, entitled "A Voltage Reference And Current Source For Video DAC," filed concurrently herewith; and U.S. patent application Ser. No. 08/098,840, Attorney Docket No. P3510-P16US entitled "Method and System for Generating Dynamic Zoom Codes," filed concurrently herewith.

BACKGROUND OF THE INVENTION

When data is presented pictorially, our well developed two and three dimensionally oriented eye-brain pattern recognition mechanism allows us to perceive and process many types of data very rapidly and efficiently. In fact, in many implementation, design, and construction processes, pictures are virtually indispensable for visualizing and communicating.

However, creating and reproducing a meaningful picture presents problems that have stood in the way of widespread use of pictures. The ancient Chinese proverb "a picture is worth a thousand words" only became a cliche in our society after the introduction of technological means (the printing press and later photography) of producing and reproducing pictures easily and cheaply.

These technology breakthroughs made it fast and easy to capture the essence of an idea or situation with an illustrative drawing or photograph. No longer was it necessary to painstakingly draw, carve, or paint individual copies of a scene.

Today, the blending and enhancing of the interrelationship of computer graphics and video are the most important mechanized means of producing and reproducing pictures since the invention of the television.

Video provides us with the opportunity to review events which have already occurred and to witness events, which we otherwise could not attend, as they unfold. Graphics, on the other hand, with the assistance of a computer, provides the advantage of enabling us to create and perceive pictures of abstract, synthetic objects, including graphs and charts. Lastly, interactive graphics, which is a form of human-machine interaction, combines the best features of the interactiveness of textural communication with the graphical communication of two and three dimensional plotting.

Arguably, static pictures were often a good means of communicating information, dynamically varying pictures are frequently even better. This is especially true when one needs individualized time varying phenomena, both real (e.g., deflection of an aircraft wing in supersonic flight, or the evolution of a human face from childhood through old age) and abstract (e.g., growth trends such as the use of nuclear energy in the USA or the population movement from cities to suburbs and back to the cities, as functions of time).

A movie is therefore often more expressive in showing changes over time than, say, a sequence of slides. Similarly, a dynamic sequence of frames on a display console can often convey smooth motion or changing form better than a slowly changing sequence of individual frames. This is especially true when the user can control the animation by adjusting its speed, the proportion of the total scene and the amount of detail shown, and other effects. In a video format, adjustments are made by reversing the image, scaling and zooming, as well as other video manipulations. Much of the technology for the mixing of video and graphics therefore deals with a combination of hardware and software techniques.

Thus, the mixing of video and graphics allows us to achieve much higher bandwidth human-machine communication using a judicious combination of text with static and dynamic pictures than is possible with text alone. This higher bandwidth makes a significant difference in our ability to understand data, perceive trends, and visualize real or imaginary objects. By making communication more efficient, mixing technology makes possible greater productivity, higher quality and more precise results or products, and lower analysis and design costs.

Traditionally, video and graphics data, which are in digital format, are stored within two frame buffers, or memory storage areas. The graphics data is stored in one memory area, while the video data is stored in another memory area. Both sets of data are accessed and converted to an analog signal. These analog signals are then mixed, on a pixel by pixel basis, and sent to a display station.

This method of mixing video and graphics data is referred to as a "video overlay," i.e., the video data is overlaid on top of the graphics data. There are three traditional methods for accomplishing this.

One method teaches that within the graphics environment, a particular color is defined to be an overlay color. In other words, by designating a particular color as the overlay or transparent color, the implementation of the method treats all instances of that color as transparent, i.e., wherever that color appears within the graphics data, video data will be seen to show through. This method of mixing video with graphics is well-known as the "Overlay Key Color Method." A second method of mixing video data with graphics data is to actually create a rectangular window, and utilize the window to create a window-within-a-window image. This method is now available in many television sets, as the "picture-within-the-picture," the difference being that in such an implementation two video signals are being mixed, as opposed to video and graphics signals. With this method, the graphics data provides the background, while the video data is mapped to the rectangular window area. This creates the appearance that the video data is on top of the graphics data. This is known as the "X-Y Window" method of mixing video and graphics data.

The last method utilizes a system for "tagging" a stream of video data. The video data is evaluated and a search is conducted for a particular color or range of colors, each piece of data having such a range is then chroma key color tagged. Later, when the video is mixed with the graphics data, the video is projected on top of the graphics, and each chroma-key color tagged piece of data is treated as either opaque or transparent. The piece of data which was not tagged is therefore treated in a complemented manner. This is known as the "Video Chroma Key Tag" method of mixing video and graphics data.

Each of the three above methods is hardware dependent. As such, only one method may be implemented within one computer at a particular time. This limits the user to that specific implementation.

Thus, a user wishing to implement the Video Chroma Key Tag Method on a computer in which one of the other two methods exists is required to physically remove the hardware supporting the present method and insert the Video Chroma Key Tag hardware in its place.

Accordingly, there exists a need in the art for a means by which to switch dynamically among the various graphics and video mixing methods which is both efficient and accurate.

There exists a further need in the art for a means by which to switch among the various graphics and video mixing methods which is hardware independent.

There exists still a further need in the art for a means by which to switch among the various graphics and video mixing methods which can operate in real-time.

There exists still a further need in the art for a means by which to utilize the various graphics and video mixing methods such that they interact and cooperate with each other to coexist simultaneously upon a single display device.

SUMMARY OF THE INVENTION

These and other needs and features are achieved by the present invention in which a circuit mixes received streams of graphics and video signals to create a desired output format. The circuit selects a subset of a set of opcodes, which selection is predicated upon the desired output format of the mixed signals.

The present invention has taken the three disclosed output formats of the prior art and combined them into one mechanism such that switching between said methods is now transparent to the user, i.e., switching among the various methods is hardware independent. Further, the implementation of the present invention enables the user to use the methods in tandem, such that they cooperate through each other to create more vivid and useful displays.

In the preferred embodiment, an eight bit register is coupled to an 8-to-1 multiplexer. The register is responsible for storing the opcodes which are used to determine, on a pixel by pixel basis, whether video or graphics data should be displayed to the screen. Put another way, the cooperation between the multiplexer and the register containing the opcodes provides a means for controlling the selective switching among graphics and video data streams as a function of the evaluation of said opcodes. The selective switching is accomplished on a pixel by pixel basis.

Therefore, a technical advantage of the present invention is that the various methods for mixing video and graphics signals are implemented such that switching between methods is transparent to the user as the invention is hardware independent.

A further technical advantage is that on a pixel by pixel basis, a display screen can be created which may simultaneously incorporate the features of several of the mixing methods.

A still further technical advantage of the present invention is that, in the preferred embodiment, the claimed invention operates in real-time.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE INVENTION

Prior to undertaking a detailed analysis of the present invention, it would be advantageous to explore three of the existing methods of mixing video and graphics signals which may be used to create a single display screen. All three methods are well-known in the prior art.

Figure 3:
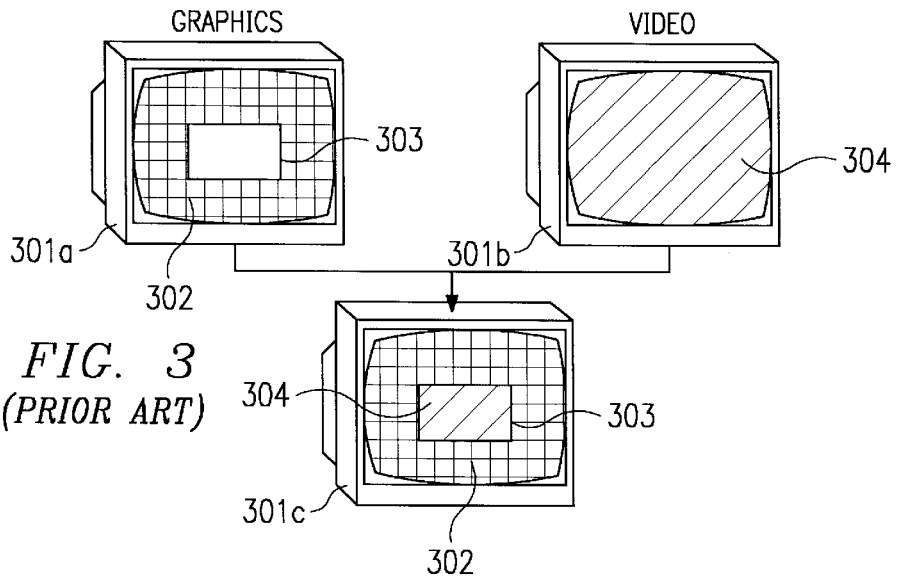
FIG. 3 (PRIOR ART)
FIG. 3 illustrates an isometric view of three display screens on a computer monitor wherein the Overlay Color Key Method of the prior art is implemented.

Turning to FIG. 3, there is illustrated an isometric view of three display screens on a display monitor wherein the Overlay Color Key Method of the prior art is implemented. Display monitor 301*a* is shown to display a graphics image 302. Graphics image 302 provides the background for the Overlay Color Key Method. A rectangular box, or window 303, is imbedded within graphics image 302. Window 303, representing an overlay color key, appears as a unique color which the mechanism (not shown) implementing the Overlay Color Key Method seeks to replace during the overlay process.

Display monitor 301*b* is shown to display a video image 304. Video image 304 is displayed as it would appear if displayed alone, i.e., displayed without a graphics portion.

Display monitor 301*c* is shown to display a mixture of graphics image 302 and video image 304, the result of the overlay process. The mixture of the two images 302, 304 is accomplished by the implementation mechanism of the Overlay Color Key Method which scans the graphics data, representative of graphics image 302, for data representing the unique color identifying window 303. The mechanism undertakes the replacement of the data window 303 with the video data representing video image 304.

The result is display monitor 301*c*, wherein the video image 304 appears within window 303 of graphics image 302.

Figure 4:
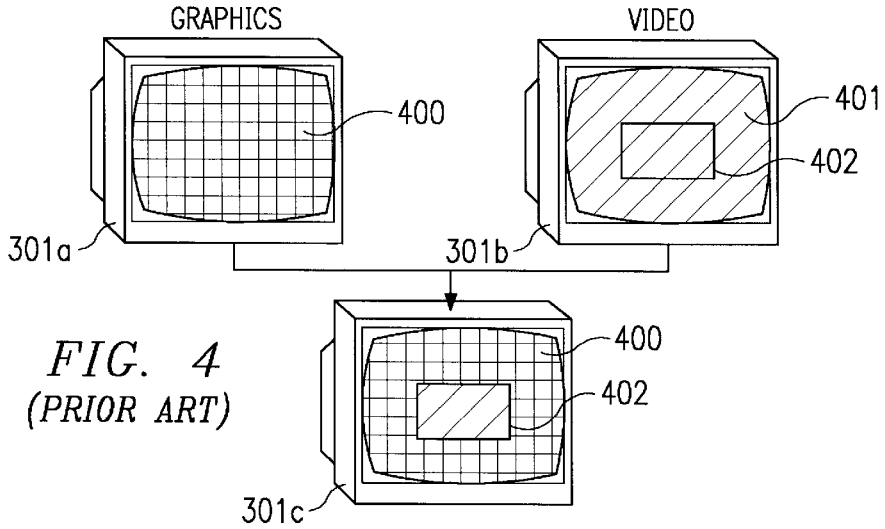
FIG. 4 (PRIOR ART)
FIG. 4 illustrates an isometric view of three display screens on a computer monitor wherein the X-Y Window Method of the prior art is implemented.

Turning now to FIG. 4, there is illustrated an isometric view of three display screens on a display monitor wherein the X-Y Window Method of the prior art is implemented. The X-Y Window Method is also known as the Window-Within-a-Window Method.

Display monitor 301*a* is shown to display a graphics image 400. Graphics image 400 is displayed as it would appear if displayed alone, i.e., displayed without a video portion.

Display monitor 301*b* is shown to display a video image 401. A rectangular box, or X-Y Window 402, is outlined within video image 401. X-Y Window 402 provides a foreground image which the mechanism (not shown) implementing the X-Y Window Method will extricate from video image 401 and position on top of graphics image 400.

Display monitor 301*c* is shown to display a mixture of graphics image 400 and X-Y window 402 of video image 401, the result of the X-Y Window process. The mixture of graphics and video is accomplished by the implementation mechanism of the X-Y Window Method which scans the video data, representative of video image 401, for X-Y window 402. The mechanism then undertakes the stacking of X-Y window 402 on top of graphics image 400.

The result is display monitor 301*c*, wherein the video window 402 appears on top of graphics image 400.

Unlike the Overlay Color Key Method described in connection with the detailed description of FIG. 3, the present method of mixing video with graphics does not utilize imbedded information within the received graphics data to mark the area in which an overlay is to take place. Instead, the present method removes a particular area from the received video image and lays it on the top of the received graphics image.

Figure 5:
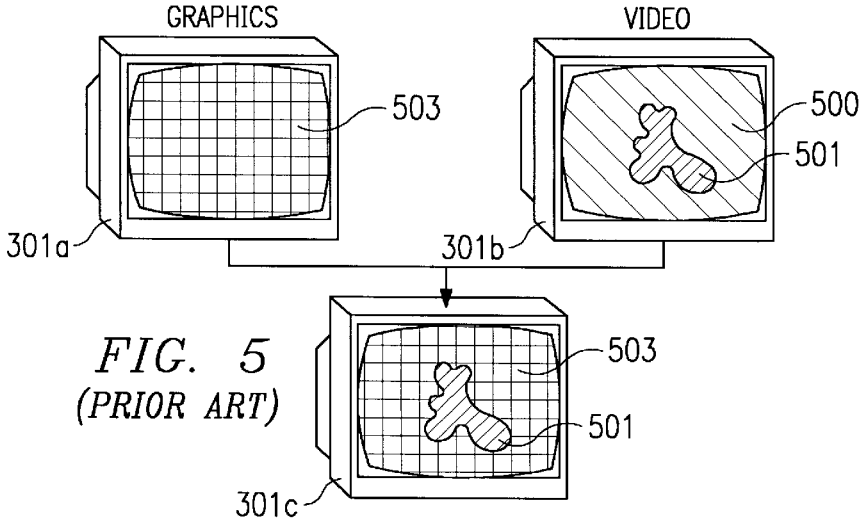
FIG. 5 (PRIOR ART)
FIG. 5 illustrates an isometric view of three display screens on a computer monitor wherein the Video Chroma Key Tag Method of the prior art is implemented.

Turning now to FIG. 5, there is illustrated an isometric view of three display screens on a display monitor wherein the Video Chroma Key Tag Method of the prior art is implemented.

Display monitor 301*a* is shown to display a graphics image 503. Graphics image 503 is displayed as it would appear if displayed alone, i.e., displayed without a video portion.

Display monitor 301*b* is shown to display a video image 500. A variable shaped image 501 is depicted within video image 500. Variable shaped image 501 provides a foreground image which the mechanism (not shown) implementing the Video Chroma Key Tag Method will extricate from video image 500 and position on top of graphics image 503.

Display monitor 301*c* is shown to display a mixture of graphics image 503 and variable shaped area 501 of video image 500, the result of the Video Chroma Key Tag process. Recall, that each point on display monitor 301 is represented by a distinct pixel, and each pixel is represented by bits of information in a digital format. Associated with each pixel bit string is a single bit which is used to determined whether or not that particular pixel is to be displayed. The mixture of graphics and video is therefore accomplished by the implementation mechanism of the Video Chroma Key Tag Method by tagging each pixel of video data. If the bit is equal to one, the pixel is "tagged" and will not be displayed, if the pixel is equal to zero, the pixel is not "tagged" and will be displayed (or vice versa).

Typically tagging is accomplished by placing the object which is to be mapped to the graphics image in front of a very distinct blue background. As the mechanism scans and evaluates the object to be displayed, the blue background area is "tagged." Subsequently, the graphics and video data are mixed creating the variable shaped image 501 depicted on monitor 301*c*. When the two images are combined, the graphics image 503 shows through, not the blue background 500, i.e., background 500 becomes a transparent color and graphics image 503 shows through.

By comparison with the X-Y Window Method discussed in connection with the detailed description of FIG. 4, the present method also fails to utilize imbedded information within the received graphics data to mark the area in which an overlay is to occur, as was the case with the Color Key Overlay Method discussed in connection with the detailed description of FIG. 3.

However, the implementation of the X-Y Window Method differs from implementation of the present method in that the X-Y Window requires the hardware to determine which pixel to display (graphics or video), thus no information is embedded within either the graphics or video data stream. By contrast, the present method embeds information within each pixel directing the hardware to proceed in a particular manner. The result is display monitor 301*c*, wherein variable shaped image 501 is stacked on top of graphics image 503.

Recall, that each of the three above described methods of mixing received graphics and video signals are available and are well known in the prior art, however, as has been previously introduced, implementations of each of these methods remain hardware dependent. Hardware dependent means that one and only one of the three methods may be implemented within one computer at one time. Thus, a user utilizing a first method of mixing graphics and video, and wishing to switch to and utilize a second method, is required to physically "unplug" the hardware supporting the first method and physically "plug in" in lieu thereof the hardware supporting the second method.

In today's multimedia/information processing society such a mechanical procedure for switching between methods can at best be described as cumbersome. Further, there are no existing means by which to blend or incorporate the features of the above three methods to create more enhanced images of the inter-relationship of computer graphics and video.

It is to these deficiencies to which the present invention is directed.

Figures 1, 2:
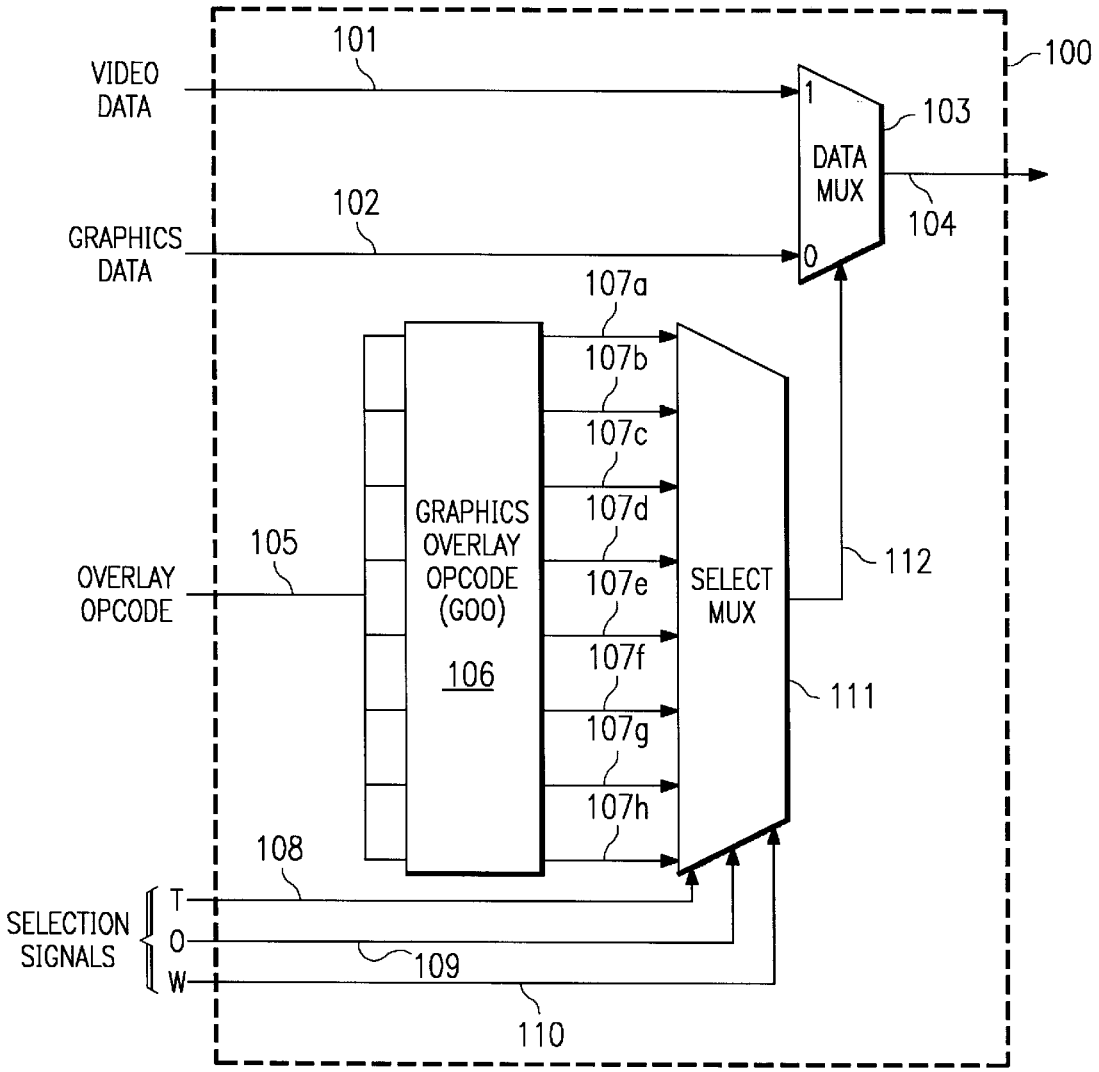
FIG. 1 illustrates a schematic diagram of the mixing circuit of the present invention.
FIG. 2 illustrates a truth table disclosing four possible programmed implementations of the mixing circuit of FIG. 1.

Turning now to FIG. 1, there is illustrated a schematic diagram of the mixing circuit embodying the present invention. In the preferred embodiment, circuit 100 receives six input signals, a video data stream 101, a graphics data stream 102, a graphics overlay opcode 105, and three one-bit selection signals 108–110, while driving a single pixel output signal 104. For a more complete description of the operation of the video processing circuitry, reference is now made to "CL-PX2070 Preliminary Data Sheet CL-PX2070 Digital Video Processor," October, 1992, and "CL-PX2080 Preliminary Data Sheet CL-PX2080 MediaDAC," December, 1992, both available from Pixel Semiconductor, Inc., Dallas, Tex., such data sheets being incorporated herein by reference.

Video data stream 101 and graphics data stream 102 are both presented to a 2-to-1 multiplexer 103, and either or both data streams 101, 102 may be real-time. Multiplexer 103 yields pixel output signal 104, and is controlled by a binary switch regulated by an 8-to-1 multiplexer 111 via data bus 112 coupling multiplexer 111 with multiplexer 103. During periods in which binary switch 103 is "off" (equal to zero), graphics data 102 is driven over output line 104. During periods in which binary switch 103 is "on" (equal to one), video data 101 is driven over output line 104.

Multiplexer 111 receives input data via eight one-way input lines 107*a*–107*h* which couple register 106 with multiplexer 111. Register 106 contains Graphics Overlay Opcodes (also known as "GOO"). These opcodes are one bit values which are programmed by the user via an application program designed to drive a particular desired output format. Although the programming of register 106 will be the subject of further discussion in connection with FIG. 2, it is important to note that the Graphics Overlay Opcodes are reprogrammable. It is the programming and rearrangeability of the values in the opcode register which gives the present invention its ability to flexibly transition among different mixing methods, independent of the hardware implementation, to create a desired output format.

Multiplexer 111 disperses the selected Graphics Overlay Opcodes as a function of three select lines 108–110. Selection line 108 is driven by the mechanism implementing the Video Chroma Key Tag (T) Method discussed in connection with the detailed description of FIG. 5. Selection line 109 is driven by the mechanism implementing the X-Y Window (Y) Method discussed in connection with the detailed description of FIG. 3. Selection line 110 is driven by the mechanism implementing the Overlay Color Key (O) Method discussed in connection with the detailed description of FIG. 4. Thus, singular implementations or combinations of the three previously discussed mixing mechanisms select the specific graphics overlay opcode driven over bus 112 by multiplexer 111. This output signal, as previously discussed, determines whether graphics or video data will be driven over data bus 104 at any particular point in time.

In the preferred embodiment, the three disclosed methods of the prior art may be combined into eight possible output formats, three formats being each of the three methods displayed alone, one format being all three methods cooperating together to produce an elaborate graphics and video mix, another format being none of the three methods, and a final three formats being various combinations involving two of the three methods. It is nonetheless important to note that other formats can either be added or substituted without departing from the spirit or scope of the invention.

Thus, select lines 108–110 provide the means which enable the user, through the application program which loads and reloads register 106 with various graphics overlay opcodes, to organize a plurality of received graphics and video signals into some desired output arrangement, or format. This is accomplished when a distinct three bit combination of signals from the implementation of the three mixing methods is driven over select lines 108–110. Select lines 108–110 provide a means for selecting a subset of the set of graphics overlay opcodes currently programmed into register 106. This subset of graphics overlay opcodes is then driven over data bus 112 controlling the selective switch among the received graphics and video signals. The controlled selection is accomplished on a pixel by pixel basis. The signals on levels 108–110 are typically not stored but are processed in conjunction with each pixel. However, storage may be optionally provided so that the control codes need be sent only once for a group of pixels.

In the preferred embodiment, a single bit is driven over data bus 112 to control the selective switching among the received data signals. Note that the present invention is not so limited, as either multiplexer 103 or multiplexer 111 may be expanded to accommodate for a greater number of received data streams, a greater number of mixing methods, and a greater number of graphics overlay opcodes.

A truth table disclosing four of the possible programming implementations of register 106 of circuit 100 are illustrated in FIG. 2. The four GOO columns appearing to the right of the dark center line of the truth table each represent possible graphics overlay opcodes for register 106. Each of the three columns appearing to the left of the dark center line of the truth table, marked "T," "O," and "W," respectively, represents one of the graphics and video mixing methods discussed in connection with the detailed description of FIGS. 3–5. Note that the table is comprised of eight rows of information A-H, each row illustrative of one of the eight possible combinations of the three mixing methods discussed previously.

Column "T" corresponds to the Video Chroma Key Tag Method, column "O" corresponds to the Overlay Color Key Method, and column "W" corresponds to the X-Y Window Method. Note that a zero, "0," within a particular row A-H of any one of these columns T-W indicates that the method associated with that column and row is "off," or not selected. By contrast, a one, "1," within a particular row of any of these three columns indicates that the method associated with that column and row is "on," or selected.

The truth table presented in FIG. 2 is therefore representative four examples of the interrelationship between the three mixing methods which is embodied in the present invention.

At this juncture, the best means of explaining the advantages of the present invention would be to walk through the four possible programmings of register 106 presented by the graphics overlay opcodes of FIG. 2. Note that although four examples of sets of graphics overlay opcodes are presented, two hundred and fifty-six possible implementations are possible. Thus, the application programmer through his application program is free to load register 106 with a vast number of possibilities. The number of possibilities can be further expanded by adding more bits to register 106 and expanding multiplexer 111.

Recall as was discussed in connection with the detailed description of FIG. 1, that application software loads register 106 with a set of graphics overlay opcodes. This loading may be repeated as often as necessary to meet the needs of a user. Further note that register 106 can have multiple levels (a memory array) such that a user could enter a plurality of opcodes, each selected dynamically as desired. These opcodes are presented to multiplexer 111 via data buses 107*a*–107*h*, and multiplexer 111 switches among these values as a function of the desired output format determined by the interrelationship among the three mixing methods on a pixel by-pixel basis (line by line, segment by segment, etc.).

Turning to a first example, assume that the desired output format is a mixture of the received graphics and video data such that the desired output format is of an Overlay Color Key (O) appearing within an X-Y Window (W). In such a scenario, the only time video data would be selected by multiplexer 103 would be when both the X-Y Window (W) and the Overlay Color Key (O) Methods are selected.

Turning to GOO column 1 of FIG. 2, presented are the graphics overlay opcodes to be loaded into register 106 to produce the above output format. Note that there are only two instances in which the video data on data bus 101 will be selected (i.e., both O and W selected). The first occurs when the Video Chroma Color Key Tag (T) is not selected, while both the desired methods are selected (row D). The second instance occurs when all three methods are selected (row H).

Note that the Video Chroma Key Tag (T) Method is therefore irrelevant as to determination of the desired output format. Accordingly, for any instance in which both desired methods (W and O) are selected, a value of one will be driven over data bus 112 which will select the single pixel of video data from data bus 101 corresponding to selection signals on both levels 109(O) and 110(W).

Figure 6:
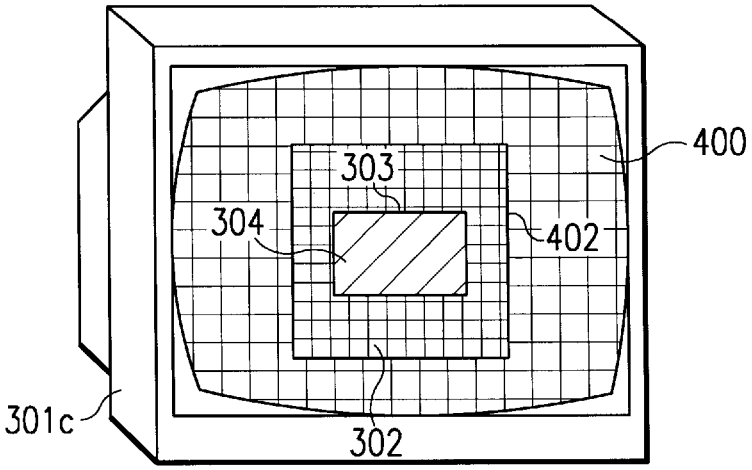
FIG. 6 illustrates an isometric view of a display screen on a computer monitor wherein the Overlay Color Key Method is mixed with the X-Y Window Method.

Turning now to FIG. 6, there is illustrated an isometric view of a display screen on a computer monitor wherein the Overlay Color Key and the X-Y Window Methods are mixed together. Display monitor 301*c* is shown to display a mixture of graphics image 400 of FIG. 4, and graphics image 302 and video image 304 of FIG. 3. Note that within graphics image 400 there exists a window 402 which following the mixture of the two methods contains the result of the Overlay Color Key Method wherein a second window 303 is found within graphics data 302 which contains video data 304.

Note that in the preferred embodiment of the invention, a single graphics data stream is received over data bus 102 of FIG. 1. Note that both graphics data 302 and 400 are therefore the same. However, should the implementation be expanded, graphics data 302 and 400 could be different or the same depending upon the programming of GOO register 106.

The purpose for desiring the ability to mix two or more of the mixing methods is to provide the user, dependent upon the programming of GOO register 106, with the tools to easily, and hardware independently, perform such operations as clipping, geometrical transformations, panning, and zooming, to name a few. Note that zooming is more fully disclosed in the aforementioned patent applications, Attorney's Docket Nos. P3510-P10US, P3510-P12US and P3510-P16US.

Turning to the second and third GOO columns of FIG. 2, it is evident that any of three methods of the prior art can be chosen singularly as is shown by the above-referenced columns wherein the Graphics Overlay Color Key (O) and the Video Chroma Key Tag (T) Methods are implemented singularly. Note that GOO column 2 is identical to column "O", and similarly, GOO column 3 is identical to column "T".

Hence, any combination of the methods may be accomplished by programming register 106 to respond to the desired interrelationship among the three mixing methods. The obvious advantage of the present invention over the prior art when displaying one of the three disclosed methods alone is the claimed invention's ability to dynamically switch among these methods, as well as to utilize any combination of the three, in a flexible, hardware independent manner.

Thus, a user utilizing the X-Y Window (W) Method is not required to "unplug" the hardware implementing the method to switch the Video Chroma Key Tag Method. Instead, the user simply instructs the application software driving the present invention to switch formats, which is accomplished by simply reloading register 106 with a different set of graphics overlay opcodes.

Turning to a final example, assume that register 106 is programmed with the information appearing in GOO column 4 of FIG. 2. The effect produced would be a Video Chroma Key Tag within an X-Y Window. Again, turning to the eight possibilities programmed within register 106, the first possibility (row A) is that all three control signals 108–110 (T, O, W) are equal to zero. In this case graphics data will be selected. Thus the signal driven over data bus 112, which controls multiplexer 103, will be zero as shown in column 4.

Moving to the second entry row (B) wherein the three 108–110 columns (T, O, W) read from left to right "OO1," the X-Y Window Method, column "W," has been selected. Note however, that the Video Chroma Key Tag Method, column "T," has not been selected. Thus, graphics data is again selected and the output signal driven over data bus 112 will again be zero. It can therefore be seen that graphics data will be selected so long as both desired methods are not concurrently selected.

Turning to both rows F and G of the truth table of FIG. 2 wherein both the X-Y Window Method, column "W," and the Video Chroma Key Tag Method, column "T", have been selected. Here, a valid combination has occurred and a value of one is driven over data bus 112 which selects the video data present on bus 101.

Note that as was the case with the Video Chroma Key Tag Method of the first example, the Graphics Overlay Color Key Method is similarly irrelevant as to determination of the desired output format. Thus, for any instance in which both desired methods are selected, a value of one will be driven over data bus 112 which will select a single pixel of video data from video bus 101.

Figure 7:
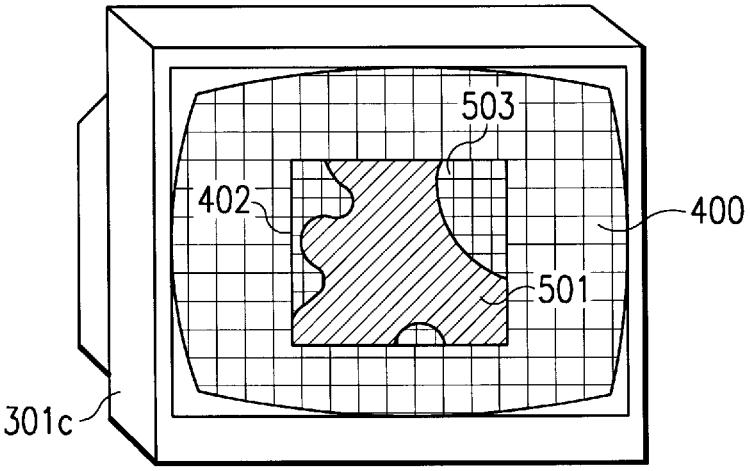
FIG. 7 illustrates an isometric view of a display screen on a computer monitor wherein the Video Chroma Key Tag Method is mixed with the X-Y Window Method.

Turning now to FIG. 7, there is illustrated an isometric view of a display screen on a computer monitor wherein the Video Chroma Key Tag and the X-Y Window Methods are mixed together. Display monitor 301*c* is shown to display a mixture of graphics image 400 of FIG. 4, and graphics image 503 and video image 501 of FIG. 5. Note that within graphics image 400 there exists a window 402 which following the mixture of the two methods contains the result of the Video Chroma Key Tag Method wherein a variable size image 501 containing video data is found within graphics data 503.

Note that in the preferred embodiment of the invention, a single graphics data stream is received over data bus 102 of FIG. 1. That being the case, graphics data 503 and 400 are the same. However, should the implementation be expanded, graphics data 503 and 400 could be different or the same depending upon the programming of GOO register 106.

Also to reiterate, the purpose for desiring the ability to mix two or more of the mixing methods is to provide the user, dependent upon the programming of GOO register 106, with the tools to easily, and hardware independently, perform such operations as clipping, geometrical transformations, panning, and zooming, to name a few. Note that zooming is more fully disclosed in the aforementioned patent applications, Attorney's Docket Nos. P3510-P10US, P3510-P12US and P3510-P16US.

Note the difference between Video Chroma Key Tag Image 501 of FIGS. 5 and 7, as FIG. 7 illustrates the zooming and clipping effect of the present invention.

Hence, any combination of the three methods may be accomplished by programming and reprogramming register 106 to respond to this multiplexing, or switching mechanism, to create any graphics/video image desired. The claimed invention therefore teaches a rich and flexible system and method for the mixing of graphics and video data signals in real-time.

In the preferred embodiment, the above disclosed circuit is realized in silicon as the real-time implementation requires performance at exceedingly high speeds. Furthermore, the prevent invention, as previously discussed, is adaptable and could easily be expanded to handle multiple video and graphic signals, as well as the incorporation of other methods of mixing graphics and video signals beyond those previously disclosed in connection with the detailed descriptions of FIG. 3–5.

Although the present invention has been disclosed in the area of video and graphic signal processing in connection with computer terminals, the use of this invention can easily be seen in the field of telecommunications.

Thus, although the present invention and its advantages have been described in detail, it should be understood that various changes, substitutions and alterations can be made herein without departing from the spirit and scope of the invention as defined by the appended claims. It should therefore be realized that the implementation of any two of the three formats, or the addition of any additional formats, remains within the spirit and scope of the invention.

What is claimed is:

1. A graphics control circuit for mixing a plurality of input signals to create a defined output signal, said mixing of input signals supporting singular and combined implementations of a plurality of input signal mixing methods, said circuit comprising:

means for storing a set of programmable overlay codes, said overlay codes containing information indicating a desired implementation of said plurality of input signal mixing methods;

means for receiving a set of selection signals representing selection of ones of said plurality of input signal mixing methods in conjunction with said input signals; and a signal selection circuit for switching among said input signals on a pixel by pixel basis to create said defined output signal, said selection circuit including:

first multiplexer circuitry having a plurality of first inputs for receiving said input signals and a second input for receiving a control signal, said first multiplexer circuitry selecting between said input signals on a pixel by pixel basis in response to a state of said control signal; and second multiplexer circuitry having a plurality of first inputs for receiving said overlay codes stored in said means for storing, a plurality of second inputs for receiving said set of selection signals representing selection of ones of said plurality of input signal mixing methods, and an output for presenting said control signal to said second input of said first multiplexer circuitry, said second multiplexer circuitry passing a selected bit of said overlay codes through said output as said control signal in response to said selection signals.

2. The circuit as set forth in claim 1 wherein said storing means includes a dynamic register.

3. The circuit as set forth in claim 1 wherein said signal selection circuit includes:

a multiplexer controlled by a binary input, said multiplexer operable for switching a selected one of said input signals to said output under control of said binary coded input.

4. The circuit as set forth in claim 3 wherein said binary coded input is selected by said codes received in conjunction with said input signals.

5. The circuit as set forth in claim 1 wherein said codes received in conjunction with said input signals are received on a pixel by pixel basis with said input signal.

6. The circuit as set forth in claim 5 further including means for storing said codes received in conjunction with said input signals, and means for providing said stored codes for a plurality of said pixels.

7. The circuit as set forth in claim 1 wherein at least one of said input signals is a video signal.

8. The circuit as set forth in claim 7 wherein said video signal is real-time.

9. The circuit as set forth in claim 1 wherein at least one of said input signals is a graphics signal.

10. The circuit as set forth in claim 9 wherein said graphics signal is interactive.

11. The circuit of claim 1 wherein said set of selection codes comprises a video chroma key tag indicator, an overlay color key indicator, and an X-Y window indicator.

12. A video graphics processor supporting singular and combined implementations of a plurality of input signal mixing methods comprising:

a first multiplexer for switching between a plurality of input signals on a pixel by pixel basis in response to a supplied control signal;

a second multiplexer for providing said supplied control signal to said first multiplexer; and a register for providing selectable inputs indicating a desired implementation of said plurality of input signal mixing methods to said second multiplexer for selection by said second multiplexer as said supplied control signal, said selection controlled by a set of command signals representing ones of said plurality of input signal mixing methods received in conjunction with said input signals.

13. The processor as set forth in claim 12 wherein said register includes inputs for receiving signals representative of said selectable multiplexer inputs.

14. The processor as set forth in claim 12 wherein said register is a dynamic register.

15. The processor as set forth in claim 12 wherein said supplied control signal is a binary coded input.

16. The processor as set forth in claim 12 wherein said set of command signals received in conjunction with said input signals are received on a pixel by pixel basis with said input signal.

17. The processor as set forth in claim 16 wherein said set of command signals received in conjunction with said input signals are stored for a group of said pixels.

18. The processor as set forth in claim 12 wherein at least one of said input signals is a video signal.

19. The processor as set forth in claim 18 wherein said video signal is real-time.

20. The processor as set forth in claim 12 wherein at least one of said input signals is a graphics signal.

21. The processor as set forth in claim 20 wherein said graphics signal is interactive.

22. The processor of claim 12 wherein said set of command signals includes a video chroma key tag indicator.

23. The processor of claim 12 wherein said set of command signals includes a video chroma key tag indicator and an overlay color key indicator.

24. The processor of claim 12 wherein said set of command signals includes a video chroma key tag indicator and an X-Y Window indicator.

25. A method of providing a dynamic display output signal in a desired output form which is the selected combination of a plurality of input signals, said selected combination supporting singular and combined implementations of a plurality of input signal mixing methods, and where the output form typically remains constant over a period of time, said method comprising the steps of:

providing said input signals to respective inputs of a controllable switch;

generating a selection control signal on a pixel by pixel basis comprising the substeps of:

providing an opcode indicating a desired implementation of said plurality of input signal mixing methods to data inputs of a multiplexer; and providing selection signals representing individual ones of said plurality of input signal mixing methods to the select inputs of the multiplexer to select a bit of said opcode as a control signal; and providing to said controllable switch on a pixel by pixel basis said control signal for selecting one of said input signals.

26. The method as set forth in claim 25 wherein said providing an opcode step includes the step of:

storing said opcode in a memory.

27. The method as set forth in claim 26 wherein said memory is a dynamic register.

28. The method as set forth in claim 25 wherein said other signals include:

a Video Chroma Key Tag indicator;

an Overlay Color Key indicator; and a X-Y Window indicator.

29. The method as set forth in claim 25 wherein at least one of said input signals is a video signal.

30. The method as set forth in claim 29 wherein said video signal is real-time.

31. The method as set forth in claim 25 wherein at least one of said input signals is a graphics signal.

32. The method as set forth in claim 31 wherein said graphics signal is interactive.

33. A method of mixing a plurality of received data signals to create a desired output format of said data signals, said desired output format supporting singular and combined implementations of a plurality of video mixing methods, said method comprising the steps of:

selecting a subset of a set of reprogrammable opcodes as a function of said desired output format of said mixed signals;

receiving video mixing indicators, said video mixing indicators comprising a Video Chroma Key Tag indicator, an Overlay Color Key indicator, and an X-Y Window indicator; and selectively switching among said received data signals on a pixel by pixel basis, said selective switching controlled by said selected subset of said set of reprogrammable opcodes interacting with said video mixing indicators.

34. A method of mixing a plurality of received data signals to create a desired output format of said data signals, said desired output format supporting singular and combined implementations of a plurality of video mixing methods, said method comprising the steps of:

selecting a subset of a set of opcodes as representing desired output format of said mixed signals as a function of a plurality of video mixing indicators including a video chroma key indicator, said set of opcodes including information regarding implementation of said plurality of video mixing methods;

receiving said video mixing indicators comprising a Video Chroma Key Tag indicator, an Overlay Color Key indicator, and an X-Y Window indicator;

selectively switching among said received data signals on a pixel by pixel basis, said selective switching controlled by said selected subset of opcodes interacting with said video mixing indicators; and storing said video mixing indicators for a group of said pixels.

35. A graphics control circuit for mixing two or more input signals according to a plurality of different input signal mixing schemes, said circuit comprising:

means for selecting which of the different input signal mixing schemes are utilized at any particular pixel with respect to each of the input signals; and means for outputting a desired signal resulting from said mixing two or more input signals.

36. The circuit as set forth in claim 35 wherein said selecting means comprises a set of selectable inputs indicating a desired implementation of said plurality of input mixing methods.

37. The circuit as set forth in claim 36 wherein said selecting means further comprises:

means for processing a set of selection signals representing selection of ones of said plurality of input signal mixing methods, said processing means operable with said selectable inputs to select the different input signal mixing schemes utilized at any particular pixel.

38. The circuit as set forth in claim 35 wherein said selecting means comprises:

a first multiplexer adapted to receive said two or more input signals and a control signal, said first multiplexer being further adapted to output said desired signal resulting from said mixing two or more input signals; and a second multiplexer adapted to receive a set of selectable inputs indicating a desired implementation of said plurality of input mixing methods and a set of selection signals representing selection of ones of said plurality of input signal mixing methods, said second multiplexer being further adapted to output said control signal as a function of said received set of selectable inputs and said received set of selection signals.

39. The circuit as set forth in claim 35 wherein at least one signal mixing scheme of said plurality of different input signal mixing schemes is selected from the group consisting of:

Video Chroma Key Tag;

Overlay Color Key; and

X-Y Window.

40. A method of mixing two or more received data signals according to a plurality of different input signal mixing schemes, said method comprising the step of:

selecting which of the different input signal mixing schemes are utilized at any particular pixel with respect to each of the input signals.

41. The method as set forth in claim 40 wherein said selecting step comprises the substep of:

receiving a set of selectable inputs indicating a desired implementation of said plurality of input mixing methods.

42. The method as set forth in claim 41 wherein said selecting step further comprises the substep of:

processing a set of selection signals representing selection of ones of said plurality of input signal mixing methods, said processing step operable with said selectable inputs to select the different input signal mixing schemes utilized at any particular pixel.

43. The method as set forth in claim 40 wherein at least one signal mixing scheme of said plurality of different input signal mixing schemes is selected from the group consisting of:

Video Chroma Key Tag;

Overlay Color Key; and

X-Y Window.

44. A graphics control circuit for mixing a plurality of input signals to create a defined output signal, said mixing of input signals supporting singular and combined implementations of a plurality of input signal mixing methods, said circuit comprising:

means for storing a set of programmable overlay codes containing information indicating a desired implementation of said plurality of input signal mixing methods as a function of a set of selection signals;

means for receiving said set of selection signals in conjunction with said input signals, said set of selection signals indicating selection of ones of said plurality of mixing methods, said set of selection signals comprising a Video Chroma Key Tag indicator, an Overlay Color Key indicator, and an X-Y Window indicator; and a signal selection circuit for switching among said input signals on a pixel by pixel basis to create said defined output signal, said selection circuit including:

first multiplexer circuitry having a plurality of first inputs for receiving said input signals and a second input for receiving a control signal, said first multiplexer circuitry selecting between said input signals on a pixel by pixel basis in response to a state of said control signal; and second multiplexer circuitry having a plurality of first inputs for receiving said overlay codes stored in said means for storing, a plurality of second inputs for receiving said set of selection signals, and an output for presenting said control signal to said second input of said first multiplexer circuitry, said second multiplexer circuitry passing selected information of said overlay codes through said output as said control signal in response to said selection signals.

45. The circuit as set forth in claim 44 wherein said storing means includes a dynamic register.

46. The circuit as set forth in claim 44 wherein said control signal comprises a binary coded input is selected from said overlay codes by said set of selection signals received in conjunction with said input signals.

47. The circuit as set forth in claim 44 wherein said set of selection signals received in conjunction with said input signals are received on a pixel by pixel basis with said input signal.

48. The circuit as set forth in claim 47 further including means for storing said set of selection signals received in conjunction with said input signals, and means for providing said stored set of selection signals for a plurality of said pixels.

49. The circuit as set forth in claim 44 wherein at least one of said input signals is a video signal.

50. The circuit as set forth in claim 49 wherein said video signal is real-time.

51. The circuit as set forth in claim 44 wherein at least one of said input signals is a graphics signal.

52. The circuit as set forth in claim 51 wherein said graphics signal is interactive.

53. A method of mixing a plurality of received data signals to create a desired output format of said data signals, said desired output format supporting singular and combined implementations of a plurality of video mixing methods, said method comprising the steps of:

selecting a subset of a set of reprogrammable opcodes as a function of a desired output format of said mixed signals, said reprogrammable opcodes operable to indicate an implementation of said plurality of video mixing methods as a function of video mixing indicators, receiving said video mixing indicators comprising a Video Chroma Key Tag indicator, an Overlay Color Key indicator, and an X-Y Window indicator; and selectively switching among said received data signals on a pixel by pixel basis, said selective switching controlled by a function of said selected subset of said set of reprogrammable opcodes and said video mixing indicators.

54. A method of mixing a plurality of received data signals to create a desired output format of said data signals, said desired output format supporting singular and combined implementations of a plurality of video mixing methods, said method comprising the steps of:

selecting a subset of a set of opcodes as representing said desired output format of said mixed signals as a function of a plurality of control signals, said set of opcodes including information regarding implementation of said plurality of video mixing methods;

receiving said plurality of control signals comprising a Video Chroma Key Tag indicator, an Overlay Color Key indicator, and an X-Y Window indicator;

selectively switching among said received data signals on a pixel by pixel basis, said selective switching controlled by said information of said selected subset of opcodes selected as a function of said plurality of control signals; and storing said plurality of control signals for a group of said pixels.

* * * * *